US007441881B2

(12) United States Patent
Saito

(10) Patent No.: US 7,441,881 B2
(45) Date of Patent: Oct. 28, 2008

(54) LIQUID SEAL AND LIQUID EJECTION APPARATUS

(75) Inventor: Kazuyuki Saito, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/770,549

(22) Filed: Jun. 28, 2007

(65) Prior Publication Data

US 2007/0242116 A1 Oct. 18, 2007

Related U.S. Application Data

(63) Continuation of application No. 10/921,363, filed on Aug. 19, 2004, now Pat. No. 7,244,017.

(30) Foreign Application Priority Data

Aug. 20, 2003 (JP) ..... 2003-296787
Jul. 23, 2004 (JP) ..... 2004-216537

(51) Int. Cl.
*B41J 2/175* (2006.01)

(52) U.S. Cl. ..... 347/86; 347/85

(58) Field of Classification Search ..... 347/85, 347/86

See application file for complete search history.

(56) References Cited

U.S. PATENT DOCUMENTS 5,153,612 A * 10/1992 Dunn et al. ..... 347/87
5,640,186 A 6/1997 Swanson et al.
6,130,696 A 10/2000 Mashita et al.
6,164,770 A 12/2000 Takata
6,554,412 B1 4/2003 Seino et al.
7,244,017 B2 * 7/2007 Saito ..... 347/86
2003/0038867 A1 2/2003 Yamamoto et al.
2003/0156175 A1 8/2003 Blease et al.

FOREIGN PATENT DOCUMENTS

JP 6-226992 A 8/1994
JP 6-328715 A 11/1994
JP 7-251873 A 10/1995
JP 10-258518 A 9/1998
JP 10-510306 A 10/1998
JP 11-092677 A 4/1999
JP 2001-212974 A 8/2001
WO WO 96/17885 A1 6/1996

* cited by examiner

*Primary Examiner*—An H Do
(74) *Attorney, Agent, or Firm*—Sughrue Mion, PLLC

(57) ABSTRACT

The liquid ejection apparatus is capable of reducing the increase of the viscosity of a liquid due to evaporation of the liquid and also for reducing the quantity of the atmospheric air dissolving into the ink. A liquid seal used for a liquid ejection apparatus which performs recording by ejecting a liquid, at least a part of the liquid seal is formed from a layer compound mixture material including a high molecular compound and an inorganic layer compound. The liquid seal seals the liquid. For example, the liquid seal is an ink cartridge accommodating the liquid therein, or an ink guide member for supplying the ink in the ink cartridge to a recording head unit.

11 Claims, 11 Drawing Sheets

LIQUID SEAL AND LIQUID EJECTION APPARATUS

The present patent application is a continuation of application Ser. No. 10/921,363 filed Aug. 19, 2004 now U.S. Pat. No. 7,244,017 and claims priority from a Japanese Patent Applications Nos. 2003-296787 filed on Aug. 20, 2003 and 2004-216537 filed on Jul. 23, 2004, the contents of which are incorporated herein by reference.

BACKGROUND OF THE INVENTION

1. Field of the Invention

The present invention relates to a liquid seal and a liquid ejection apparatus. More particularly, the present invention relates to a liquid seal which is used for the liquid ejection apparatus and is capable of maintaining quality of the liquid and also relates to a liquid ejection apparatus employing the liquid seal.

2. Description of the Related Art

A liquid ejection apparatus, such as an ink-jet recording apparatus, performs recording on a recording medium, such as a recording paper, by ejecting liquids, such as ink, from a fluid ejection head, such as a recording head. The liquid ejection apparatus includes a liquid accommodating container, such as an ink cartridge, which is detachably mounted with a main body of the liquid ejection apparatus. The liquid accommodating container supplies the liquid therein to a fluid ejection head through a liquid guide member, e.g., a liquid supplying tube as disclosed in Japanese Patent Laid-Open No. 2001-212974.

If viscosity of the liquid increases due to evaporation of the liquid or if air bubbles is generated in the liquid, performance of the fluid ejection head may deteriorate. In order to prevent a liquid evaporation and the increase of the viscosity, it is necessary to lessen the evaporation through a liquid accommodating chamber, the liquid guide member, and the fluid ejection head. Moreover, in order to prevent generating air bubbles in the liquid, it is necessary to lessen the amount of air being entered into the fluid through the liquid accommodating chamber, the liquid guide member, and the fluid ejection head.

SUMMARY OF THE INVENTION

According to a first aspect of the present invention, there is provided a liquid seal used for a liquid ejection apparatus which performs recording by ejecting a liquid. At least a part of the liquid seal is formed from a layer compound mixture material including a high molecular compound and an inorganic layer compound. The liquid seal seals the liquid. According to the liquid seal, compared with a case if it does not include the inorganic layer compound, the amount of the ink solvent and atmospheric air permeating the liquid seal can be lessened. Therefore, the quality of the liquid is maintainable.

When the content of the inorganic layer compound in the layer compound mixture material is more than or equal to 1 percent of the weight and less than or equal to 50 percent of the weight, the amount of the ink solvent and atmospheric air permeating the liquid seal can be lessened while the characteristic of the high molecular compound is maintained.

The liquid seal may be a resin case in which the liquid is accommodated. In this way, the amount of the ink solvent and atmospheric air permeating the liquid accommodating container can be lessened.

When the liquid ejection apparatus includes: a liquid accommodating container for accommodating the liquid; and a liquid ejection unit for ejecting the liquid, the liquid seal may be a liquid guide member for supplying the liquid from the liquid accommodating container to the liquid ejection unit by allowing communication between the liquid ejection unit and the liquid accommodating container. In this way, the amount of the ink solvent and atmospheric air permeating the liquid guide member can be lessened.

When the liquid ejection apparatus includes: a liquid accommodating container for accommodating the liquid; a liquid ejection unit for ejecting the liquid; and a liquid guide member for supplying the liquid from the liquid accommodating container to the liquid ejection unit by allowing communication between the liquid ejection unit and the liquid accommodating container, the liquid seal may be a container holding member for detachably holding the liquid accommodating container and for connecting the liquid accommodating container to the liquid guide member by connecting the liquid guide member. In this way, the amount of the ink solvent and atmospheric air permeating the container holding member can be lessened.

When the liquid ejection apparatus includes: a liquid accommodating container for accommodating the liquid; a liquid ejection unit for ejecting the liquid; and a liquid guide member for supplying the liquid from the liquid accommodating container to the liquid ejection unit by allowing communication between the liquid ejection unit and the liquid accommodating container, and when the liquid ejection unit includes: a head body for ejecting the liquid outside according to a signal input from a body of the liquid ejection apparatus; a base member for holding the head body, where the base member includes a channel unit for guiding the liquid to the head body; and a joint member connecting with each of the liquid guide member and the base member for guiding the liquid supplied from the liquid guide member to the base member, the liquid seal may be the joint member. In this way, the amount of the ink solvent and atmospheric air permeating the joint member can be lessened.

The liquid seal may include a surface layer which prevents peeling of the inorganic layer compound. Thereby, even if the liquid seal is flexed, the peeling of the inorganic layer compound from the front surface can be prevented. In this case, the surface layer may be unitedly formed by the high molecular compound which does not include the inorganic layer compound. Thereby, the layer including the inorganic layer compound and the surface layer which does not include the inorganic layer compound can be unitedly formed.

The liquid seal may be formed by extrusion, and the inorganic layer compound may be allotted in the liquid seal along a direction of the extrusion. Thereby, the inorganic layer compound can be densified in a direction perpendicular to the direction of the extrusion, so that the amount of the ink solvent and atmospheric air permeating in the direction perpendicular to the direction of the extrusion can be lessened.

According to a second aspect of the present invention, there is provided a liquid ejection apparatus which performs recording on a recording medium by ejecting a liquid. The liquid ejection apparatus includes: a liquid accommodating chamber for accommodating the liquid; a liquid ejection unit for ejecting the liquid to the recording medium; a liquid seal for sealing the liquid. The liquid seal is essentially made of layer compound mixture material including a high molecular compound and an inorganic layer compound. According to the second aspect, the same effectiveness as the first aspect can be attained.

The summary of the invention does not necessarily describe all necessary features of the present invention. The present invention may also be a sub-combination of the features described above.

DETAILED DESCRIPTION OF THE INVENTION

The invention will now be described based on the preferred embodiments, which do not intend to limit the scope of the present invention, but exemplify the invention. All of the features and the combinations thereof described in the embodiment are not necessarily essential to the invention.

Figure 1:
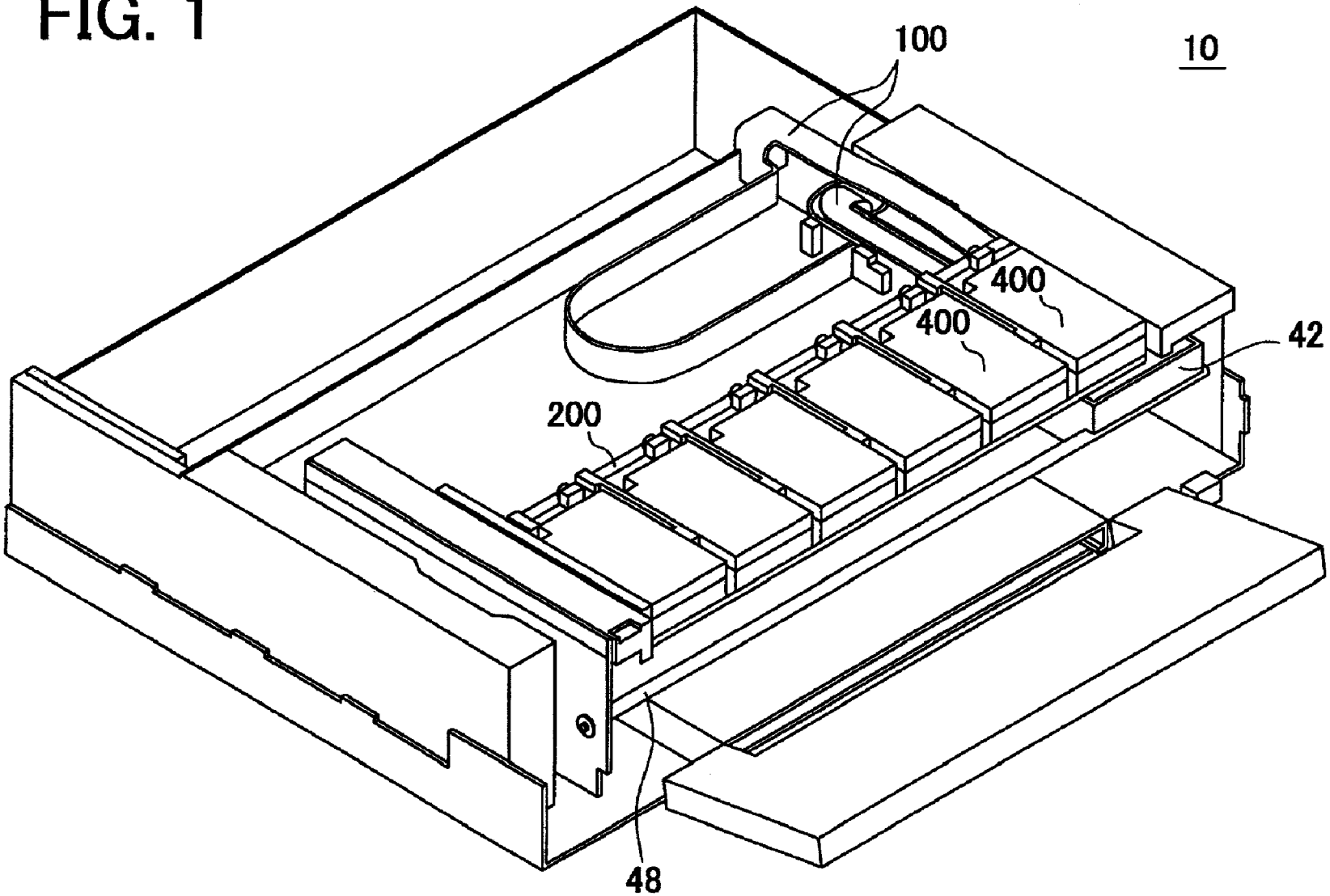
FIG. 1 is a perspective view of an ink-jet recording apparatus where a cover is removed.
Figure 2:
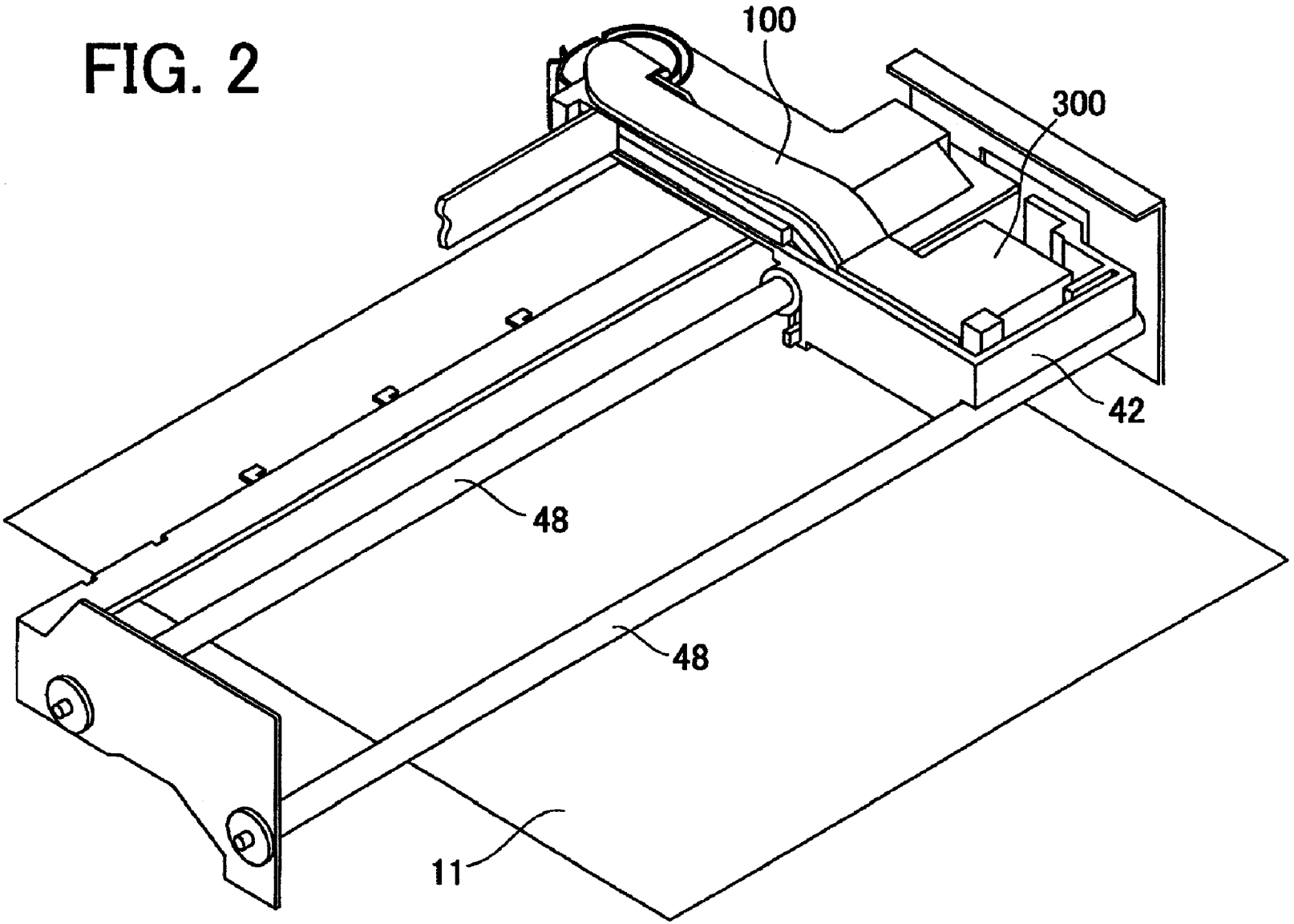
FIG. 2 is a perspective view of an ink feed system included in the ink-jet recording apparatus.

FIG. 1 is a perspective view illustrating an ink-jet recording apparatus 10 using an embodiment of the present invention where a cover is removed, and FIG. 2 is a perspective view of an ink feed system included in the ink-jet recording apparatus 10. As shown in FIG. 1 and FIG. 2, the ink-jet recording apparatus 10 includes: a carriage 42 reciprocally moving along with a main scanning direction above a recording medium 11, such as a recording paper; a recording head unit 300 mounted with the carriage 42; a plurality of ink cartridges 400 accommodating a plurality of colors of ink, respectively; a cartridge holder 200 for detachably fixing the plurality of ink cartridges 400 to the body of the ink-jet recording apparatus 10; and a rectangular-shaped ink guide member 100 which connects the recording head unit 300 to the cartridge holder 200. The ink in the ink cartridges 400 is supplied to the recording head unit 300 through the cartridge holder 200 and the ink guide member 100. The recording head unit 300 reciprocally moves with the carriage 42 along a guide shaft 48 to perform recording by the ink ejection to the recording medium 11. The cartridge holder 200 is an example of a container holding member.

At least a part of each of the ink cartridges 400, the cartridge holder 200, the ink guide member 100, and the recording head unit 300, i.e., the part being in contact with the ink, is essentially made of layer compound mixture material, which is a mixture of high molecular matter and an inorganic layer compound. For this reason, it is hard to transmit atmospheric air through the ink cartridges 400, the cartridge holder 200, the ink guide member 100, and the recording head unit 300.

Although the inorganic layer compound is montmorillonite, which is preferably an example of smectite, it may be another smectite, mica, vermiculite, halloysite, or their synthetic analog. Moreover, although the content of the inorganic layer compound in the layer compound mixture material is preferably more than or equal to 1 percent of the weight and less than or equal to 50 percent of the weigh, it is more preferable that it is more than or equal to 5 percent of the weight and less than or equal to 30 percent of the weight. In this case, the layer compound mixture material can maintain the characteristic of the high molecular matter. Moreover, the ink cartridges 400, the cartridge holder 200, the ink guide member 100, and the recording head unit 300 can be formed by ejection molding.

Figure 3:
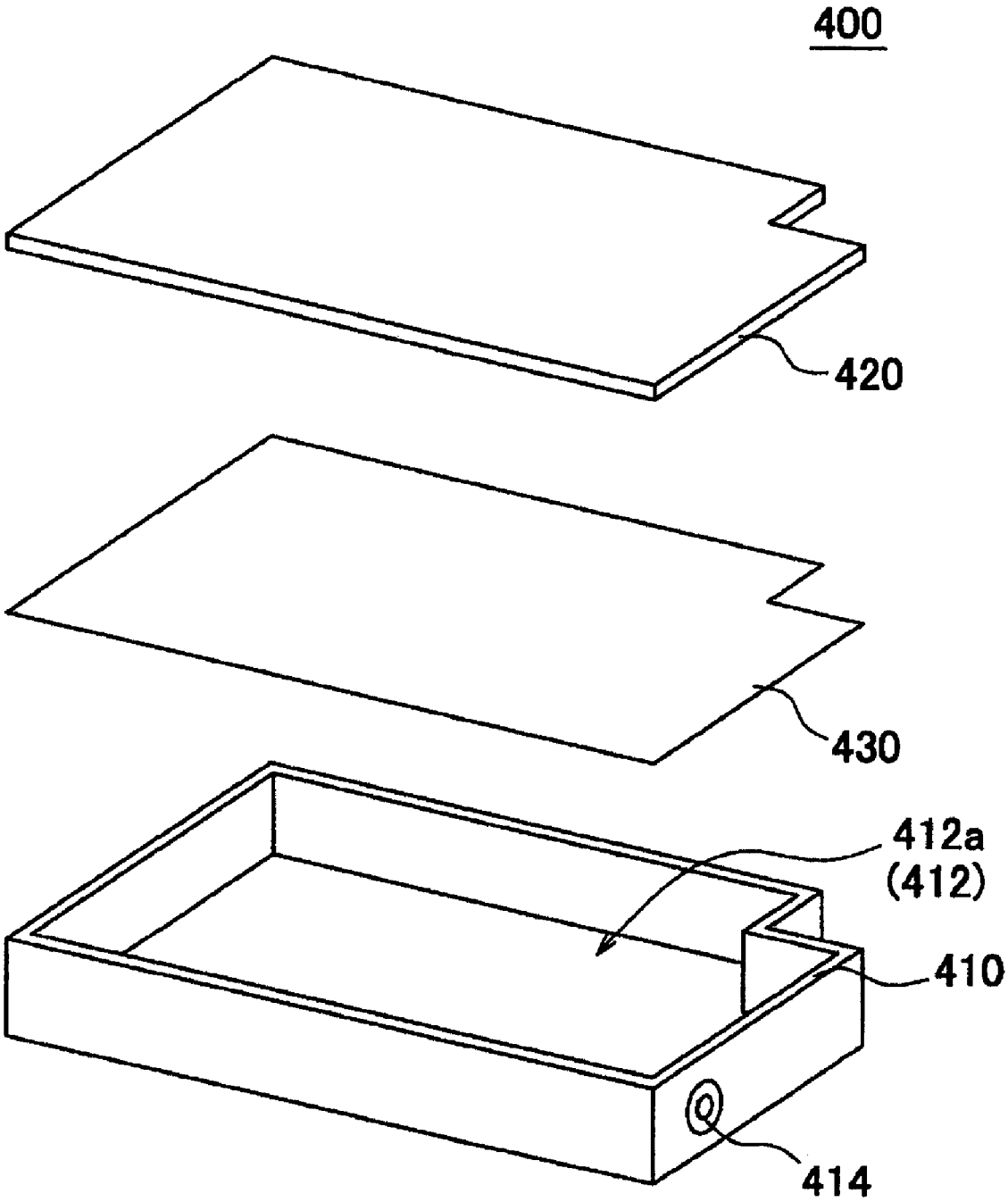
FIG. 3 is an exploded perspective view of the ink cartridge.

FIG. 3 is an exploded perspective view of the ink cartridge 400. The ink cartridge 400 includes a bottom case 410, a top case 420, and an ink sealing film 430. The bottom case 410 includes recess 412*a* on a surface joined to the top case 420, and further includes an ink supply port 414 at a surface for supplying the ink outside. The ink sealing film 430 is welded on the perimeter of the recess 412*a* to form an ink accommodating chamber 412 which accommodates the ink in the lower case 410. The top case 420 is connected to the bottom case 410 to form a resin case of the ink cartridge 400. The bottom case 410 and the top case 420 are essentially made of the layer compound mixture material. When forming the bottom case 410 and the top case 420, the layer compound mixture material includes polypropylene as the high molecular matter.

Figure 4:
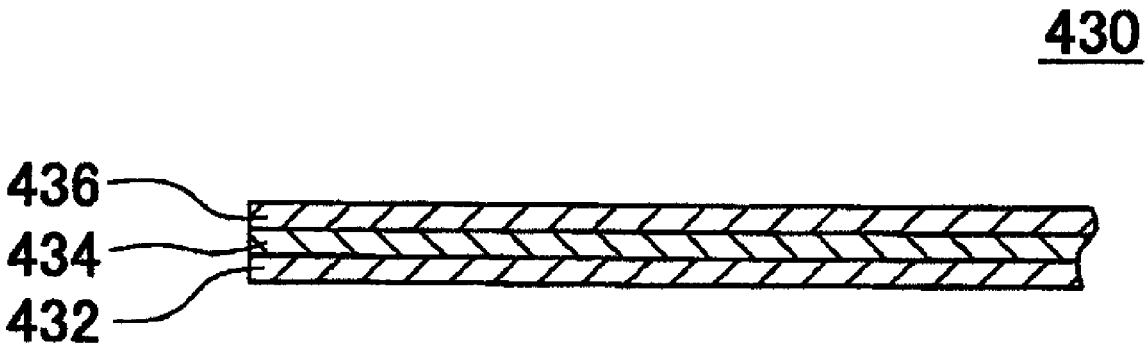
FIG. 4 is a sectional view of the ink sealing film.

FIG. 4 is a sectional view of the ink sealing film 430. The ink sealing film 430 includes a welding film 432, a mixture film 434, and a heat-resistant film 436 in this order from a side to be welded to the bottom case 410. The welding film 432 includes material similar to the bottom case 410, and welded to the bottom case 410. When the bottom case 410 includes polypropylene, the welding film 432 is formed with cast polypropylene. The mixture film 434 is essentially made of the layer compound mixture material, and prevents the ink solvent and the atmospheric air permeating the ink sealing film 430. When forming the mixture film 434, the layer compound mixture material includes polypropylene as the high molecular matter. The heat-resistant film 436 is essentially made of material of which a softening point higher than the welding film 432, and when welding the welding film 432, it maintains shape of the ink sealing film 430.

Figure 5:
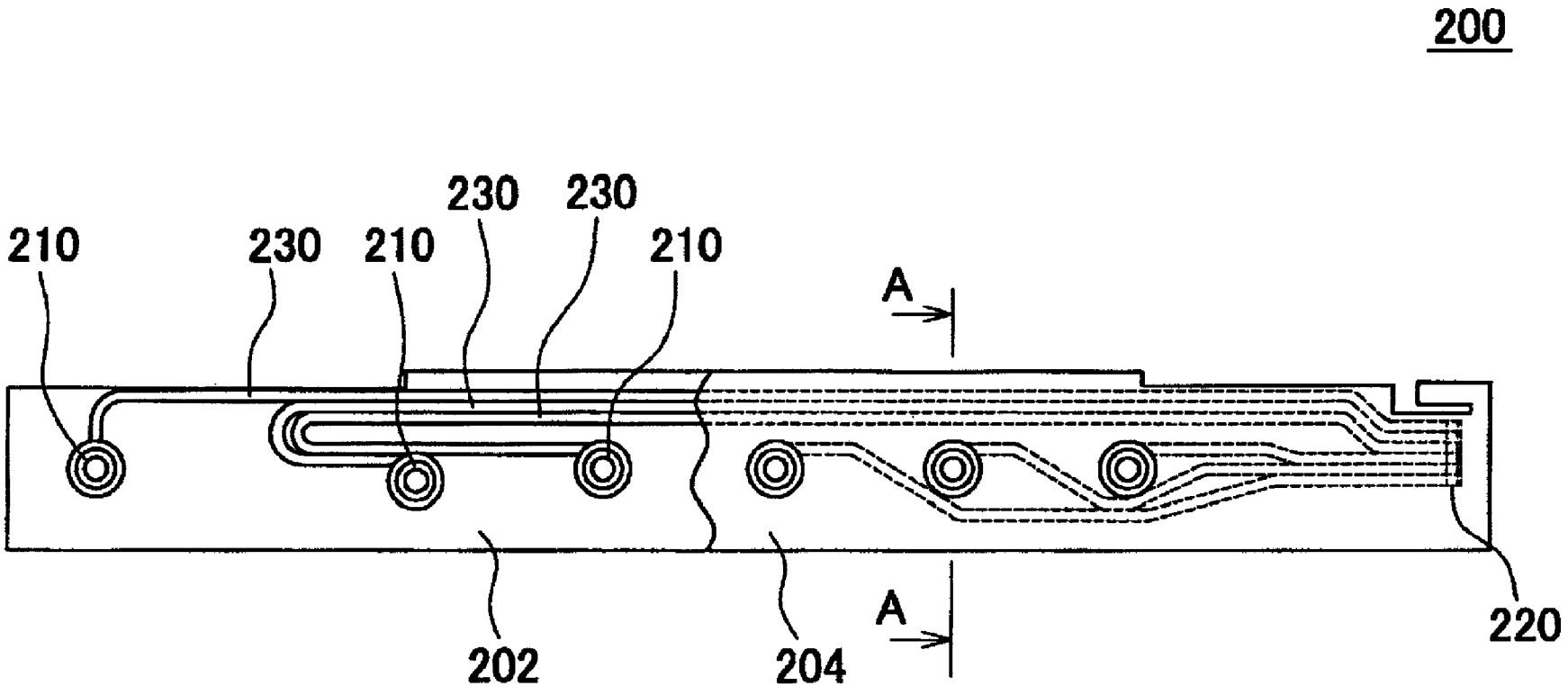
FIG. 5 is a top view of the cartridge holder.
Figure 6:
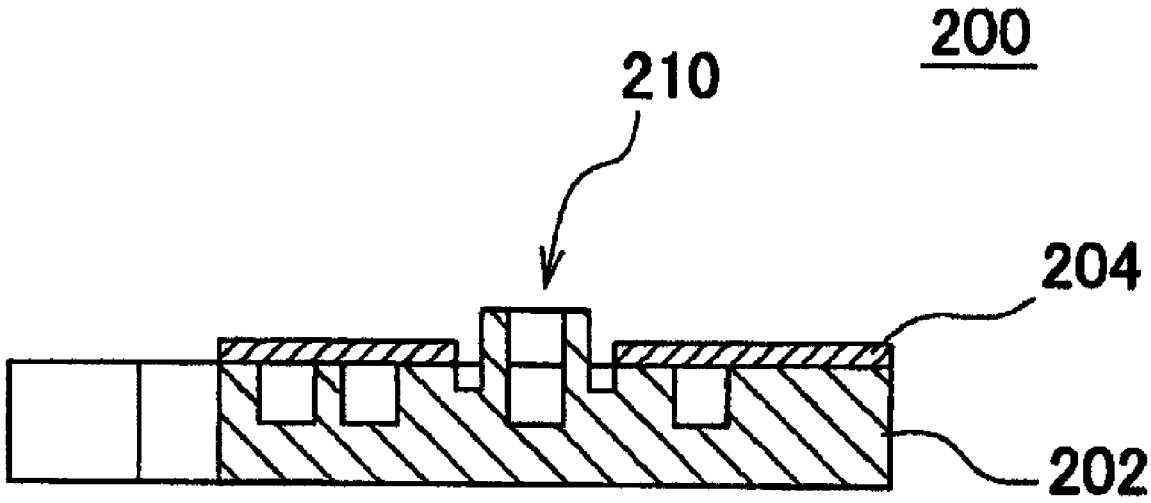
FIG. 6 is a sectional view of the cartridge holder in the A-A cross section of FIG. 5.

FIG. 5 is a top view of the cartridge holder 200, and FIG. 6 is a sectional view of the cartridge holder 200 in the A-A cross section of FIG. 5. As shown in FIG. 6, the cartridge holder 200 includes a plate-like member 202 and a sealing film 204 welded to a surface of the plate-like member 202. As shown in FIG. 5, the plate-like member 202 has a substantially rectangular shape, and includes a plurality of cylindrical cartridge connection units 210 to which the ink supply ports 414 of ink cartridges 400 are connected, a plurality of conveying member communicating pores 220 to which the ink guide member 100 is connected, and a plurality of slot units 230 which connect the plurality of cartridge connection units 210 to the conveying member communicating pores 220, respectively. The slot units 230 are formed over the surface of the plate-like member 202, and form the channels for the liquid by sealed by the sealing film 204. The plate-like member 202 is essentially made of the layer compound mixture material. When forming the plate-like member 202, the layer compound mixture material includes polypropylene as the high molecular matter. In addition, although the sealing film 204 is formed by inserting the mixture film between the welding film and the heat-resistant film like the ink sealing film 430 shown in FIG. 4 in the present embodiment, the configuration is not limited to it.

Figure 7:
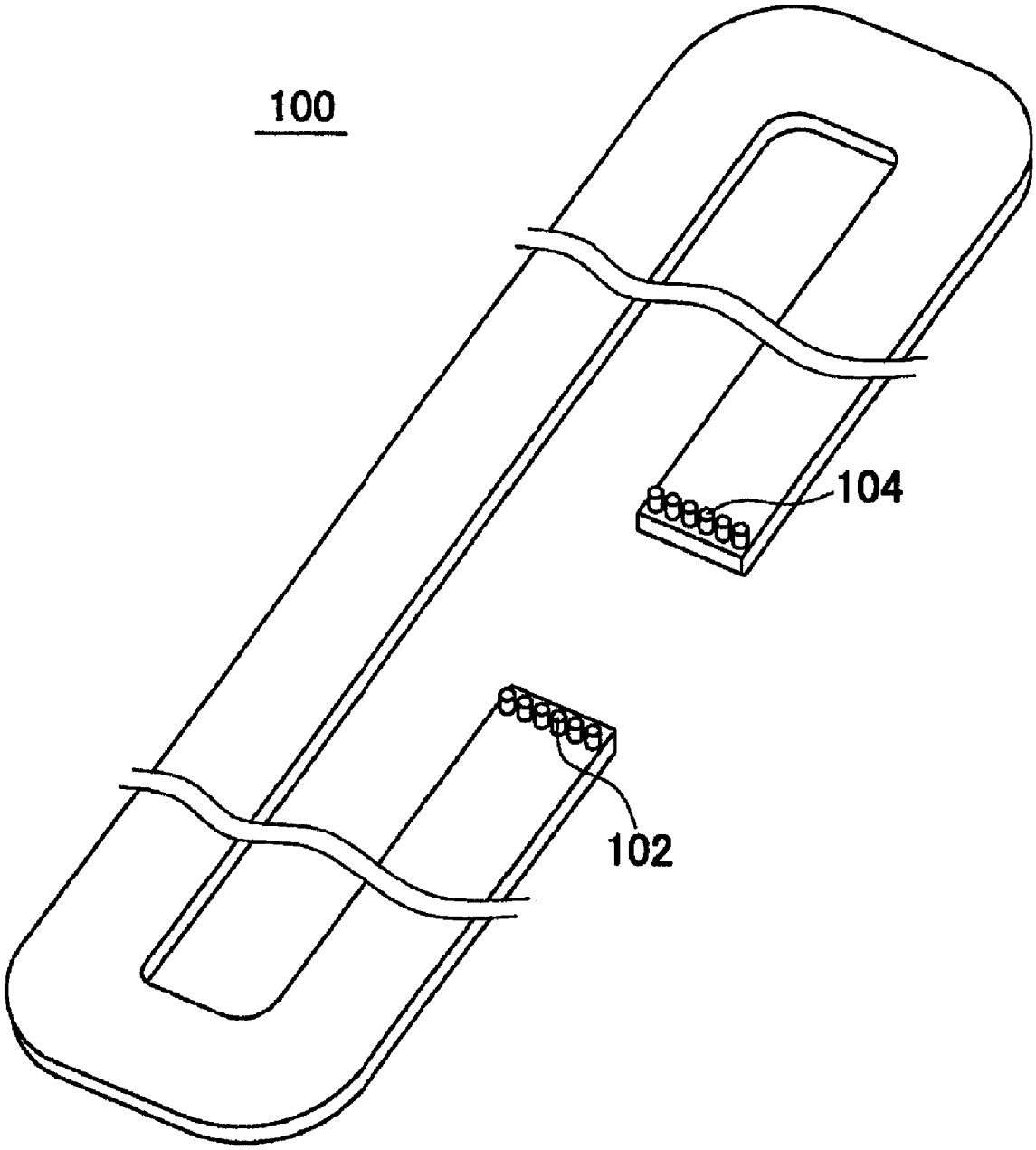
FIG. 7 is a perspective view of the ink guide member.

FIG. 7 is a perspective view of the ink guide member 100. The ink guide member 100 has a rectangular shape, and includes a plurality of cylindrical holder side connection units 102 at one end. The holder side connection units 102 are inserted to the conveying member communicating pores 220 of the cartridge holder 200. The ink guide member 100 further includes a plurality of cylindrical head side connection units 104 at the other end. The head side connection units 104 are connected to the recording head unit 300. The holder side connection units 102 and the head side connection units 104 are formed with the base 110 (to be described hereinafter) of the ink guide member 100 shown in FIG. 8 by two colors.

Figure 8:
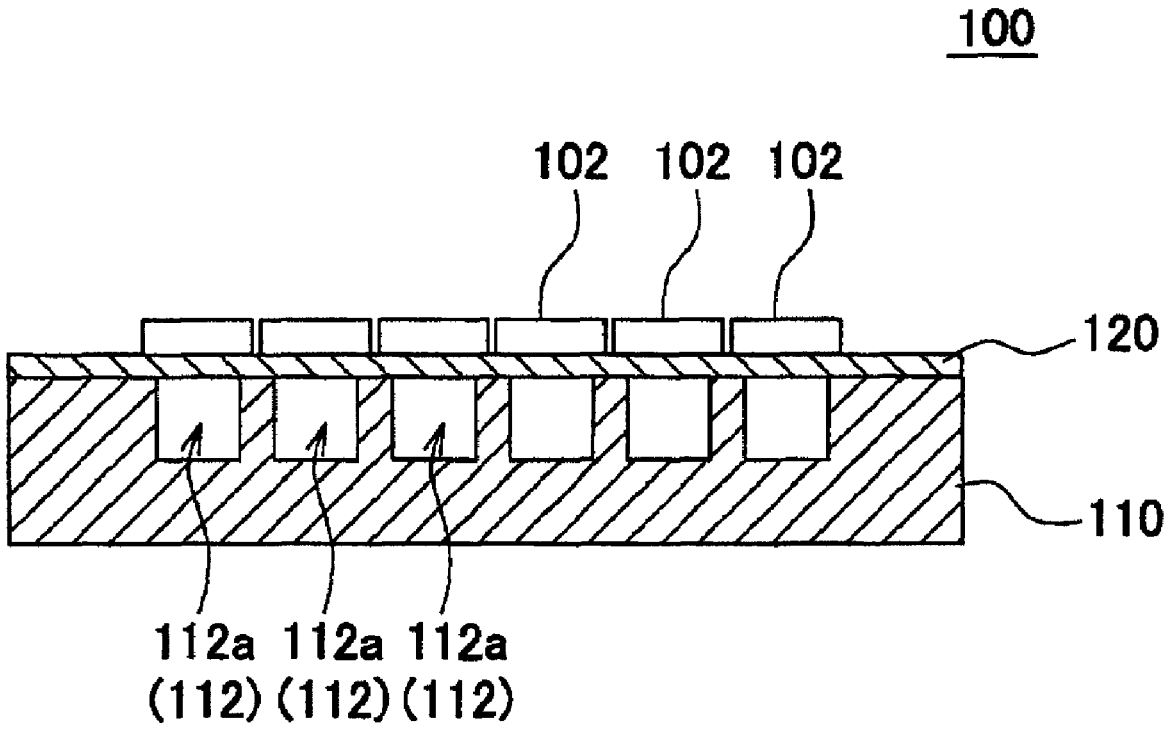
FIG. 8 is a sectional view of the cross direction of the ink guide member.

FIG. 8 is a sectional view of the cross direction of the ink guide member 100. The ink guide member 100 includes a base 110 and the ink sealing film 120. The base 110 is essentially made of the layer compound mixture material, and includes a plurality of slot units 112*a*, which extend along the longitudinal direction and are spaced apart from each other. The ink sealing film 120 is welded to whole surface of the base 110, and openings of the plurality of slot units 112*a* are sealed to form a plurality of channel units 112. As shown in FIG. 1, the ink guide member 100 connects the recording head unit 300 to the cartridge holder 200. The recording head unit 300 moves with the carriage 42. For this reason, the ink guide member 100 needs to have flexibility. When forming the base 110 of the ink guide member 100, the layer compound mixture material includes thermoplastic elastomer, for example, SEPS (polystyrene-polyethylene-polypropylene-polystyrene) polymer as the high molecular matter. In addition, although the ink sealing film 120 is formed by inserting the mixture film between the welding film and the heat-resistant film like the ink sealing film 430 shown in FIG. 3 and FIG. 4 in the present embodiment, the configuration is not limited to it.

Figure 11:
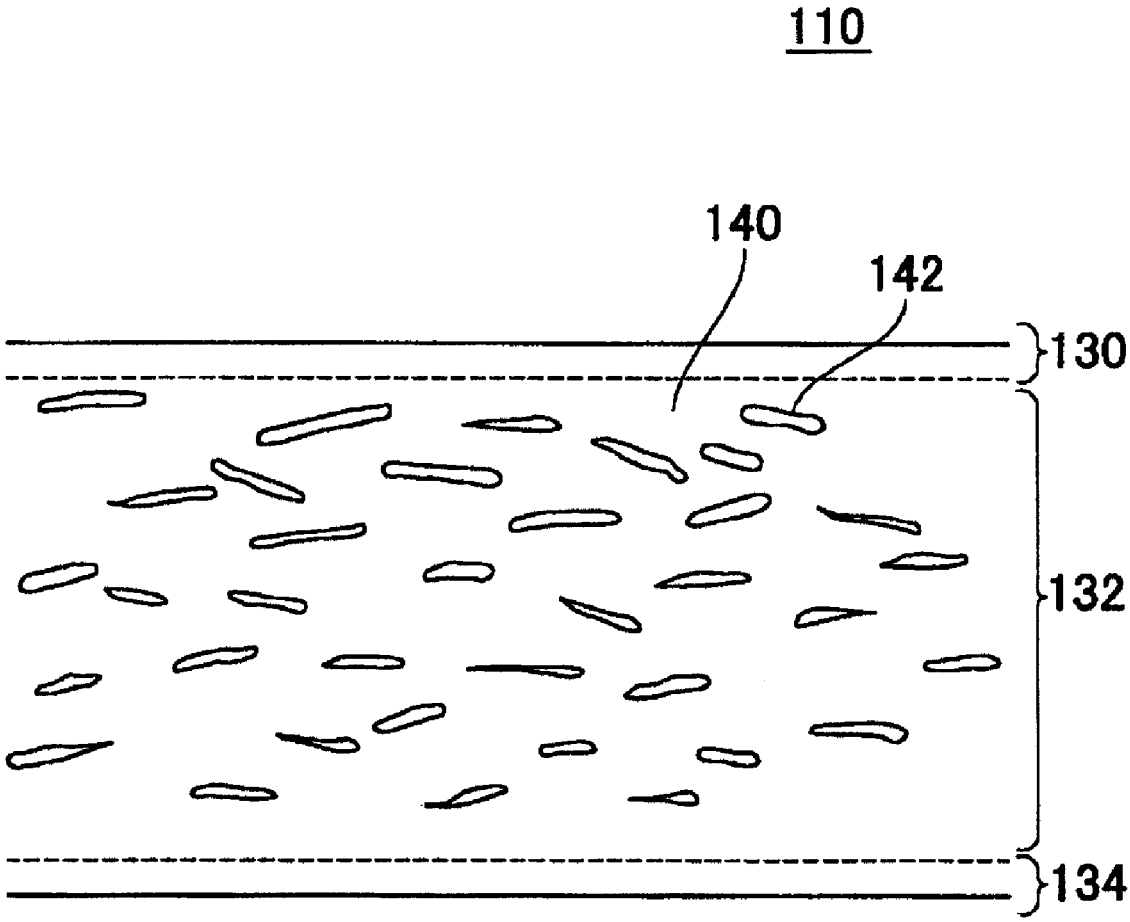
FIG. 11 is an expanded sectional view in which the cross section of the base is expanded to illustrate the outline of the configuration.

FIG. 11 is an expanded sectional view in which the cross section of the base 110 is expanded to illustrate the outline of its configuration. FIG. 11 illustrates the base 110 being cut in the thickness direction along the longitudinal direction of the base 110. For purposes of description, scale of the inorganic layer compounds 142 is magnified in the Figure.

The base 110 shown in FIG. 11 includes an central layer 132 including a inorganic layer compound 142 and a high molecular compound 140, and the surface layers 130 and 134 arranged on surfaces of the central layer 132. The central layer 132 and the surface layers 130 and 143 are formed by extruding the layer compound mixture material, which is a mixture of the inorganic layer compound 142 and the high molecular compound 140, towards a predetermined direction. In FIG. 11, the direction of the extrusion is right (or left) direction. By the force of the extrusion, the inorganic layer compound 142 is aligned along the direction of the extrusion of the central layer 132. Thereby, the inorganic layer compound 142 can be densified in a direction perpendicular to the direction of the extrusion. Therefore, in the base 110, the amount of the ink solvent and atmospheric air passing in the direction perpendicular to the direction of the extrusion (the vertical direction in FIG. 11) can be lessened.

At the time of the extrusion molding, the high molecular compound 140 in the surfaces being in contact with open air is cured faster than a central area. In this case, since the high molecular compound 140 is cured from the front surfaces towards the center pushing the inorganic layer compound 142 to the central area, the surface layers 130 and 134 are essentially made of the high molecular compound 140 which do not include the inorganic layer compound 142. Therefore, the surface layers 130 and 134 which do not include the inorganic layer compound 142 and the central layer 132 which includes the inorganic layer compound 142 can be formed unitedly and easily. Moreover, since the central layer 132 and the surface layers 130 and 134 are unitedly formed including the same high molecular compound 140, peeling between these layers can be prevented.

The above-mentioned surface layers 130 and 134 prevent peeling of the inorganic layer compounds 142 provided in the central layer 132. Thereby, even if the base 110 is flexed, the peeling of the inorganic layer compound 142 on its front surfaces can be prevented. Moreover, since the inorganic layer compound 142 does not appear on the front surfaces of the base 110, the inorganic layer compound 142 can be prevented from hooking other components on the front surfaces of the base 110.

Figure 9:
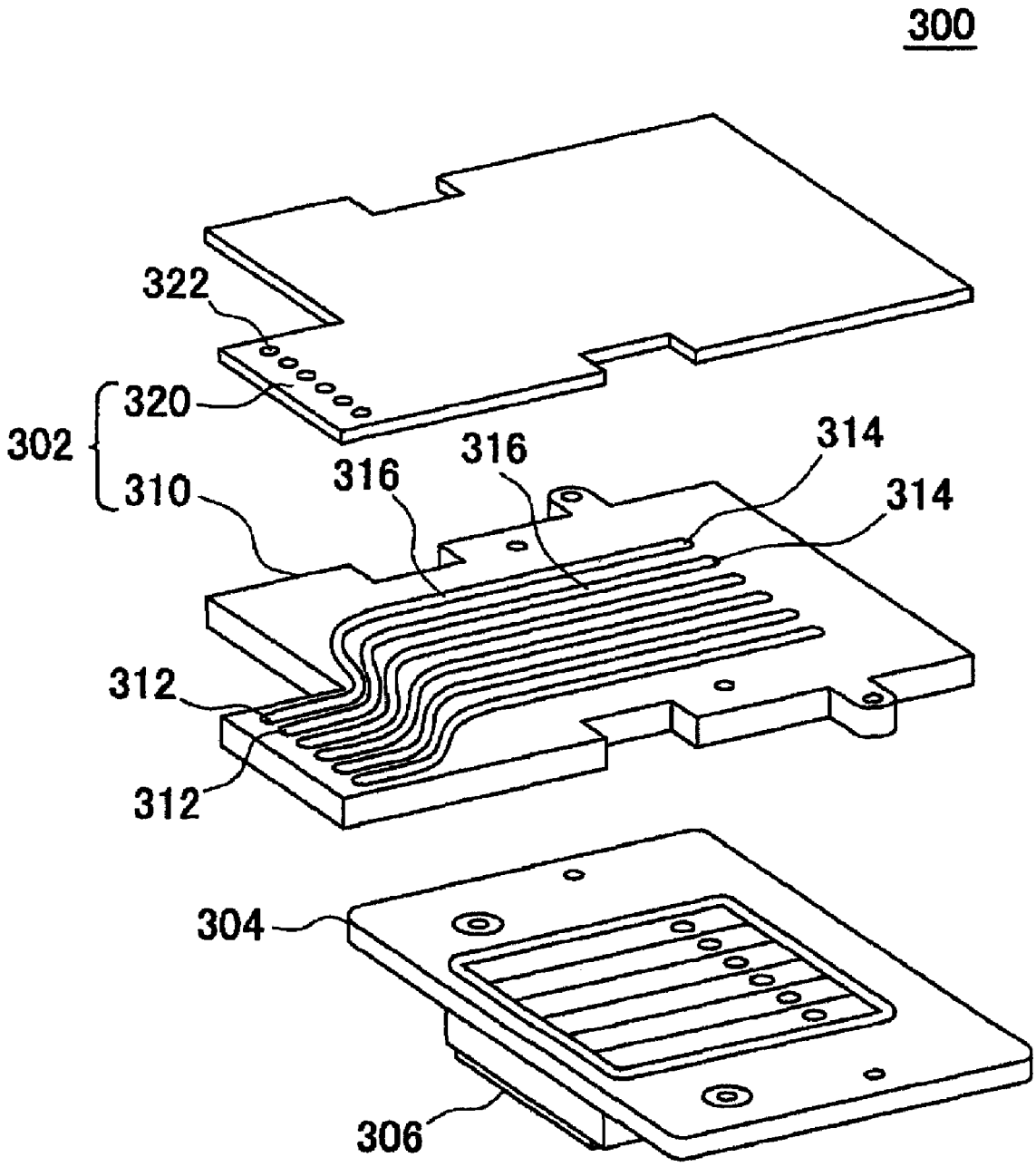
FIG. 9 is an exploded perspective view of the recording head unit.

FIG. 9 is an exploded perspective view of the recording head unit 300. The recording head unit 300 includes a joint member 302, a base member 304, and a head body 306. The head body 306 ejects the ink onto the recording medium 11 shown in FIG. 2 according to the signal input from the body of the ink-jet recording apparatus 10. The base member 304 holds the head body 306, and supplies ink to the head body 306.

The joint member 302 includes a sealing film 320, which is welded to the whole surface of the connection base 310, and the connection base 310. The connection base 310 has a plurality of conveying member connection unit 312, head side connection units 314, and a plurality of channel grooves 316. The conveying member connection unit 312 is exposed from film ports 322 formed in the sealing film 320, and receives a plurality of kinds of ink respectively by inserting the head side connection units 104 of the ink guide member 100. Sealing of the head side connection units 314 is accomplished by the sealing film 320, and it is connected to the base member 304 and supplies the plurality of kinds of ink to the base member 304, respectively. The channel grooves 316 guides the plurality of kinds of ink received by the conveying member connection units 312 to the head side connection units 314, respectively. The connection base 310 is essentially formed of the layer compound mixture material. When forming the connection base 310, the layer compound mixture material includes the polyphenylene ether resin as the high molecular matter. The composition of the sealing film 320 is similar to the ink sealing film 430 shown in FIGS. 3 and 4 except for the composition of the welding film 432. In the sealing film 320, a layer corresponding to the welding film 432 is essentially made of the material similar to polyphenylene ether resin. However, it should be noted that the sealing films 320 is not limited to it.

Figure 10:
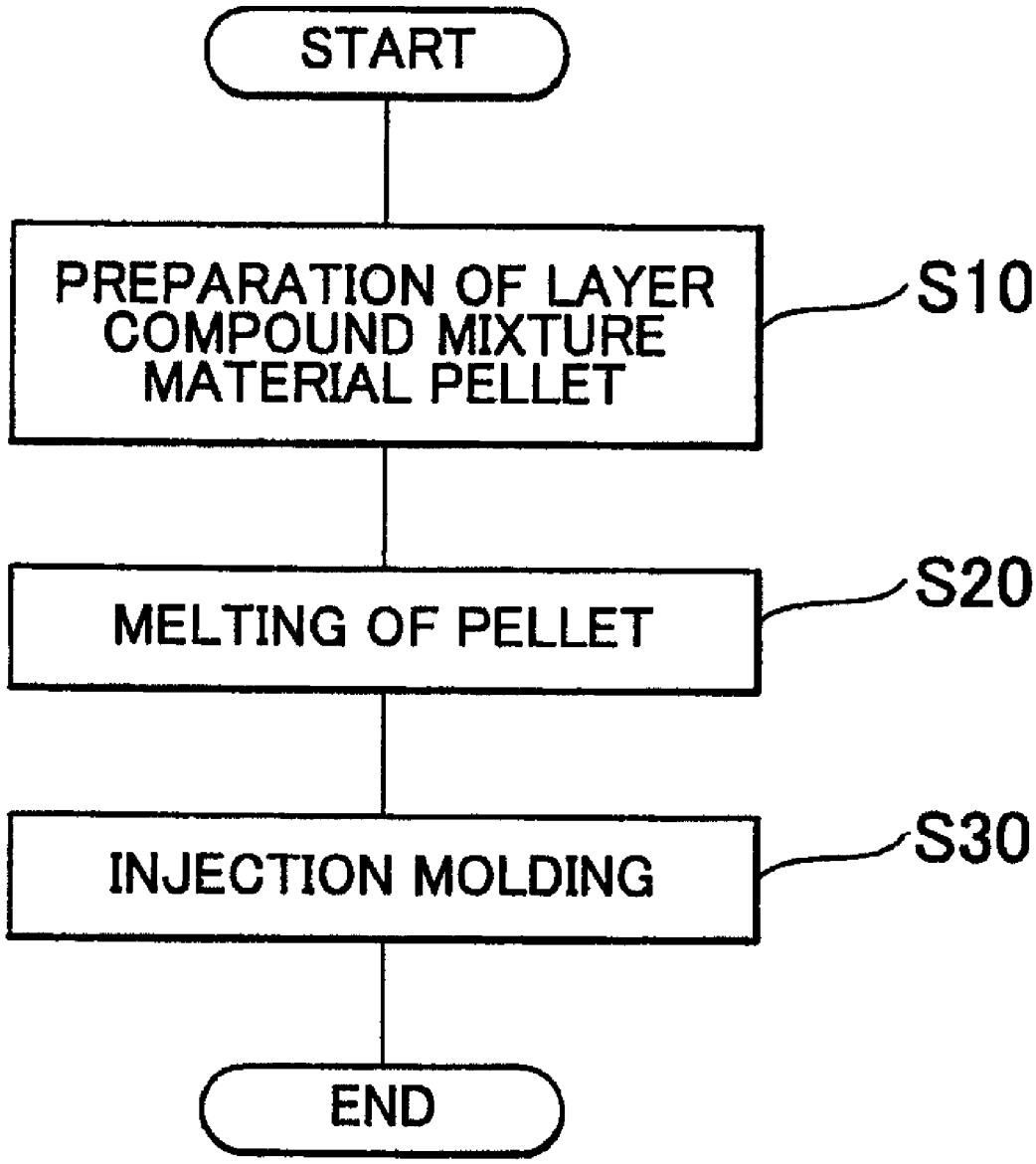
FIG. 10 is a flowchart illustrating a manufacturing process of the bottom case 410, etc.

FIG. 10 is a flowchart illustrating a manufacturing process of the bottom case 410 and the top case 420 of the ink cartridge 400, the plate-like member 202 of the cartridge holder 200, and the base 110 of the ink guide member 100. First, the pellet of the layer compound mixture material, which is the mixture of the inorganic layer compound and the high molecular matter, is prepared (S10). Then, the pellet is melted (S20), and placed into a die. Then, the bottom case 410, the top case 420, the plate-like member 202, and the base 110 are ejection molded (S30). In this way, the bottom case 410, the top case 420, the plate-like member 202, the base 110, and the connection base 310 can be formed by ejection molding.

As mentioned above, as for the ink-jet recording apparatus 10, since the bottom case 410 and the top case 420 of the ink cartridge 400, the plate-like member 202 of the cartridge holder 200, and the base 110 of the ink guide member 100 are essentially made of the layer compound mixture material, which is the mixture of the inorganic layer compound (e.g., montmorillonite) and the high molecular matter, it is hard for the atmospheric air to dissolve into the ink. For this reason, gas ejection from the recording head unit 300 instead of the ink, or so called "dot defect", is reduced, and even if it performs continuation recording, recording quality does not deteriorate so easily. Moreover, frequency of ink ejection for the restoration from the dot defect, i.e., frequency of cleaning, is reduced. Therefore, the quantity of the ink that is used for the recording purpose can be increased. Moreover, since the ink solvent cannot evaporate easily until the ink reaches the recording head unit 300, the viscosity of the ink does not increase so easily.

Moreover, as for the member conventionally formed by the ejection molding, it can be manufactured by the same process as the former method except that the process of making the layer compound mixture material is added. Therefore, the increase in manufacturing cost is avoidable.

In addition, the ink-jet recording apparatus 10 is an example of a liquid ejection apparatus. Moreover, the ink cartridge 400 is an example of an ink accommodating container, and the recording head unit 300 is an example of a liquid ejection unit. However, the liquid ejection apparatus is not limited to it. Other examples of a liquid ejection apparatus are a color filter manufacturing apparatus for manufacturing a color filter of a liquid crystal display. In this case, the cartridge accommodating coloring material is an example of a liquid accommodating container. Yet another example of the liquid ejection apparatus is an electrode forming apparatus for forming electrodes of an organic EL display, an FED (field luminescence display), and the like. In this case, a cartridge accommodating electrode material (conduction paste) of the electrode forming apparatus is an example of the liquid accommodating container. Yet another example of the liquid ejection apparatus is a biochip manufacturing apparatus for manufacturing a biochip. In this case, the cartridge of the biochip manufacturing apparatus accommodating organic substance and a sample is an example of the liquid accommodating container. The liquid ejection apparatus of the present invention further includes another liquid ejection apparatus having an industrial application. The recording medium is an object onto which the recording is performed by ejecting the liquid, and includes a circuit board on which circuit patterns such as display electrodes are formed, a CD-ROM on which a label is printed, and a prepared slide on which a DNA circuit is recorded, as well as the recording paper.

Although the present invention has been described by way of exemplary embodiments, it should be understood that those skilled in the art might make many changes and substitutions without departing from the spirit and the scope of the present invention which is defined only by the appended claims.

What is claimed is:

1. A liquid seal for use in a liquid cartridge, comprising at least a part which is formed from a layer compound mixture material including a high molecular compound and an inorganic layer compound, the liquid seal sealing the liquid, a direction of said inorganic layer compound being approximately perpendicular to a direction that ink solvent and atmospheric air pass through the liquid seal.

2. The liquid seal as claimed in claim 1, wherein the content of the inorganic layer compound in the layer compound mixture material is more than or equal to 1 percent of the weight and less than or equal to 50 percent of the weight.

3. The liquid seal as claimed in claim 1, wherein the liquid seal is a resin case in which the liquid is accommodated.

4. The liquid seal as claimed in claim 1, further comprising a surface layer which prevents the inorganic layer compound from peeling off.

5. The liquid seal as claimed in claim 4, wherein said surface layer is integrally formed by the high molecular compound which is free of the inorganic layer compound.

6. The liquid seal as claimed in claim 1, wherein the liquid seal is formed by extrusion, and the inorganic layer compound is allotted in the liquid seal along a direction of the extrusion.

7. A liquid seal as claimed in claim 6, wherein the direction of the extrusion is approximately perpendicular to a direction in which ink solvent and atmospheric air pass through the liquid seal.

8. A liquid sealing film at least a part of which is welded to a liquid cartridge, comprising:

a welding film which is welded to the part of the liquid cartridge;

a mixture film which is formed from a layer compound mixture material including a high molecular compound and an inorganic layer compound, and a heat-resistant film which has a soflening point higher than that of said welding film, wherein said welding film, said mixture film and said heat-resistant film are arranged in the above order from a side to be welded to the liquid cartridge.

9. A liquid cartridge comprising the liquid sealing film as claimed in claim 8.

10. The liquid seal as claimed in claim 8, wherein the mixture film comprises a layer compound.

11. The liquid seal as claimed in claim 10, wherein a direction of the layer compound is approximately perpendicular to a direction that atmospheric air passes through the liquid sealing film.

* * * * *